United States Patent [19]

Doering

[11] Patent Number: 4,723,741

[45] Date of Patent: Feb. 9, 1988

[54] ADJUSTABLE BAG HOLDER

[75] Inventor: Charles W. Doering, Louisville, Ky.

[73] Assignee: Brinly-Hardy Co., Inc., Louisville, Ky.

[21] Appl. No.: 929,635

[22] Filed: Nov. 12, 1986

[51] Int. Cl.[4] ..... B65B 67/12

[52] U.S. Cl. ..... 248/97; 248/164; 248/166

[58] Field of Search ..... 248/95, 97, 98, 99, 248/164, 166, 168, 170, 431; D6/462; D34/5, 6; 53/390

[56] References Cited

U.S. PATENT DOCUMENTS

| | | | |
|---|---|---|---|
| 241,765 | 5/1881 | Wever | 248/95 X |
| 328,741 | 10/1885 | Wiederer | 248/166 |
| 354,713 | 12/1886 | Lawson et al. | 248/97 X |
| 639,292 | 12/1899 | Rippon et al. | 248/97 |
| 1,183,124 | 5/1916 | Schwalen | 248/95 |
| 1,491,801 | 4/1924 | Holbrook | 248/164 |
| 3,659,816 | 5/1972 | Wilson | 248/97 |
| 3,893,648 | 7/1975 | Gilbert | 248/97 |
| 4,281,814 | 8/1981 | Verwey | 248/97 |

FOREIGN PATENT DOCUMENTS 75581 6/1894 Fed. Rep. of Germany .

*Primary Examiner*—J. Franklin Foss

*Assistant Examiner*—David L. Talbott

[57] ABSTRACT

An adjustable bag holder includes two U-shaped elements with a first leg of each pivotally connected to each other intermediate their ends and a second leg of each of the U-shaped elements pivotally connected to each other at the same location as the first legs are pivotally connected to each other so that the pivot axes are aligned. A torsion spring surrounds the pivot of the first legs and has one end connected to the first leg of one of the U-shaped elements and its other end connected to the first leg of the other U-shaped element. A second torsion spring surrounds the pivot of the second legs and has one end connected to the second leg of the one U-shaped element and its other end connected to the second leg of the other U-shaped element. The two torsion springs cooperate to continuously urge a connector, which extends between the two parallel legs of the first U-shaped element, and a connector, which extends between the two parallel legs of the second U-shaped element, away from each other so that a bag having its open end positioned over the two connectors is maintained under tension. When the bag holder is to be collapsed for storage, a locking ring is moved from a position adjacent one of the pivots in which the ring surrounds both of the legs connected thereto to a position in which the ring surrounds both of the connectors and holds them adjacent each other.

14 Claims, 8 Drawing Figures

FIG. 4
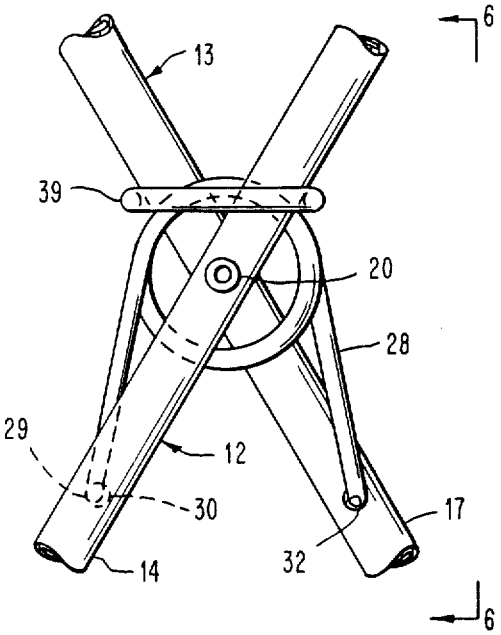
FIG. 5
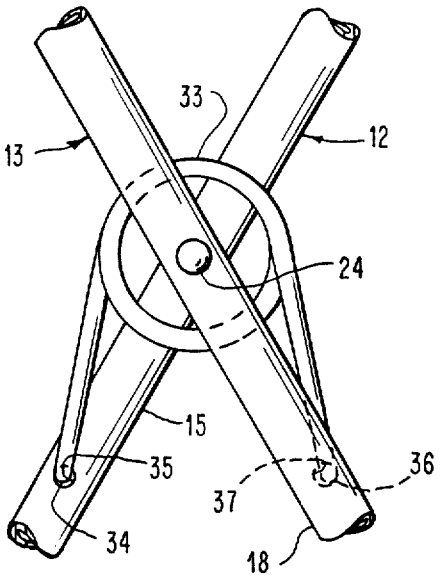
FIG. 6
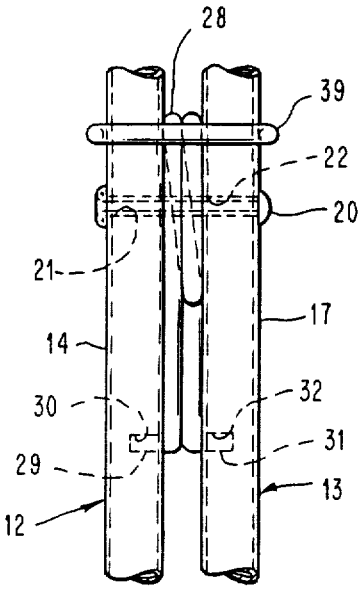
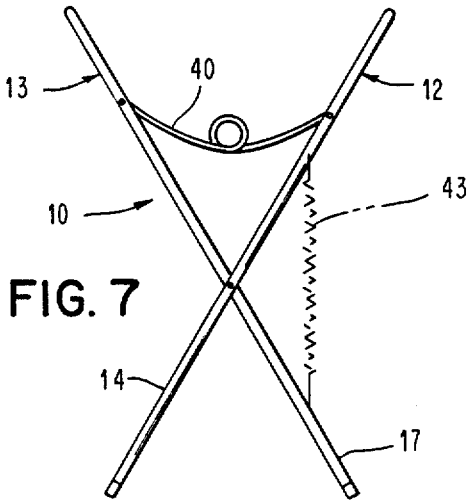
FIG. 7
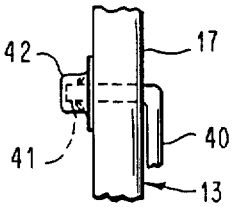
FIG. 8

ADJUSTABLE BAG HOLDER

This invention relates to an adjustable bag holder and, more particularly, to an adjustable bag holder that is automatically adjustable to the size of a bag that it is holding while being collapsible for storage purposes.

Various size plastic bags are sold to enable a user to collect debris or the like from a yard, for example, for easy pick up thereafter by trash collectors. The sizes of these plastic bags vary substantially so that the size of the opening at the top of the bag varies in accordance with the size of the bag.

Various types of bag holders for holding plastic bags with their opening facing upwardly have previously been suggested. One prior bag holder comprises a plastic bag holder having upper and lower spaced rings joined to each other by a plurality of legs extending therebetween. The upper ring has an opening of a fixed size so that clips or other means must be employed to retain the bag on the upper ring of the bag holder. Because the upper ring has a single size opening, effective filling of larger bags is not obtainable if the size of the opening is such that a small bag can be used therewith.

Another previous bag holder has a plurality of tubular elements forming a support for the open end of the bag and requiring clips to hold the bag thereon. This bag holder is a complicated and relatively expensive structure and includes wheels to enable it to roll because of its weight. The wheels are mounted at the bottom ends of each of two tubular legs forming part of one of two tubular U-shaped means. In addition to the two legs, each of the tubular U-shaped means includes two additional angular tubular elements with each having one end telescoped in the upper end of one of the legs and its other end telescoped within an end of a horizontal connector. The horizontal connector and part of each of the two angular tubular elements form a substantially flat portion. The adjacent legs of the two tubular U-shaped means are pivotally connected to each other. Beneath the pivotal connections of the two tubular U-shaped means, a U-shaped connector has the ends of its two legs secured to the two legs of the tubular U-shaped means not having the wheels. One of a plurality of spaced slots in each leg of the U-shaped connector receives retaining means on each leg of the tubular U-shaped means having a wheel. This U-shaped connector allows manual adjustment of the two tubular U-shaped means to predetermined positions. Thus, this bag holder is not automatically adjustable but is manually adjustable only to certain specific positions.

A further prior bag holder having wheels on which it rolls is a dolly structure positioned vertically and having thereon a rectangular shaped element with a fixed size opening to have a bag fit therein and be disposed over the rectangular shaped element. This requires clips or other means to retain the bag in position on the rectangular shaped element. The fixed size opening also reduces the effective opening for relatively large bags if the opening in the rectangular shaped element can accommodate smaller bags having smaller size openings.

Another previous bag holder is a single tube having a ring at its top with a pointed end at the bottom of the tube for being pushed into the ground by a user pushing on a foot brace adjacent the bottom of the tube. This not only has the disadvantages of the previously mentioned bag holders in having a limited size opening along with requiring clips or other suitable means to retain the bag on the ring but it also requires the pointed bottom end of the tube to be pushed into the ground. This limits utilization to an earth surface so that it cannot be used on a driveway, for example. This also requires the earth to be soft enough to enable the pointed end to be pushed into the ground.

A still further prior bag holder comprises a pair of L-shaped members having one leg of each mounted in an overlapping relation to the other so that the distance between the other legs, which have the bag fit thereover, of the two L-shaped members is adjustable. This can accommodate different size bags, but it requires the user to adjust the positions of the two other legs for each size bag to accommodate the different size bags through releasing connecting means holding the two L-shaped members in one position, shifting the L-shaped members to a position that it is believed that the other legs will accommodate the new size bag, and then rendering the connecting means effective. It also requires the clips or other means to retain the bag on the other legs.

The adjustable bag holder of the present invention satisfactorily overcomes the problems of the previously available bag holders in that it automatically adjusts to a wide range of plastic bags from twenty-six gallon capacity to seven bushels and requires no clips or other means to retain the open end of the bag on the bag holder. The adjustable bag holder of the present invention also is very lightweight so that even a person with relatively little strength can use it. It also is relatively inexpensive.

In addition to avoiding the need for any retaining means, the adjustable bag holder of the present invention also does not require a substantial floor area for storage. This is because it is readily collapsed when not in use so as to require only a very small floor area for storage when stacked against a wall or hung on a wall hook.

An object of this invention is to provide an adjustable bag holder that adjusts to the size of the bag positioned thereon.

Another object of this invention is to provide an adjustable bag holder that automatically retains a bag disposed thereon.

A further object of this invention is to provide an adjustable bag holder that is collapsible for storage.

Other objects of this invention will be readily perceived from the following description, claims, and drawings.

This invention relates to an adjustable bag holder for holding bags of various sizes. The bag holder includes a first U-shaped element having a first leg, a second leg substantially parallel to the first leg, and a connector extending between the first and second legs and substantially perpendicular thereto and a second U-shaped element having a first leg, a second leg substantially parallel to the first leg, and a connector extending between the first and second legs and substantially perpendicular thereto. First pivot means pivotally connects the first leg of the first U-shaped element and the first leg of the second U-shaped element to each other intermediate their ends, and second pivot means pivotally connects the second leg of the first U-shaped element and the second leg of the second U-shaped element to each other intermediate their ends with the first pivot means and the second pivot means having their axes aligned. First continuously urging means is connected to the first leg of the first U-shaped element and the first leg of the second U-shaped element for continuously urging the first leg of the first U-shaped element and the first leg of the second U-shaped element apart. Second continuously urging means is connected to the second leg of the first U-shaped element and the second leg of the second U-shaped element for continuously urging the second leg of the first U-shaped element and the second leg of the second U-shaped element apart. The first continuously urging means and the second continuously urging means cooperate to cause the connectors of the first U-shaped element and the second U-shaped element to be moved away from each other and exert a tension on a bag disposed over the connectors to retain the bag thereon.

The attached drawings illustrate preferred embodiments of the invention, in which:

FIG. 4 is a fragmentary end elevational view of a portion of the bag holder of FIG. 1 and taken along line 4—4 of FIG. 1;

FIG. 5 is a fragmentary end elevational view of another portion of the bag holder of FIG. 1 and taken along line 5—5 of FIG. 1;

FIG. 6 is a fragmentary side elevational view of the portion of the bag holder of FIG. 4 and taken along line 6—6 of FIG. 4;

FIG. 7 is a perspective view of another embodiment of the bag holder of the present invention; and FIG. 8 is an enlarged fragmentary side elevational view of a portion of the bag holder of FIG. 7.

Figure 1:
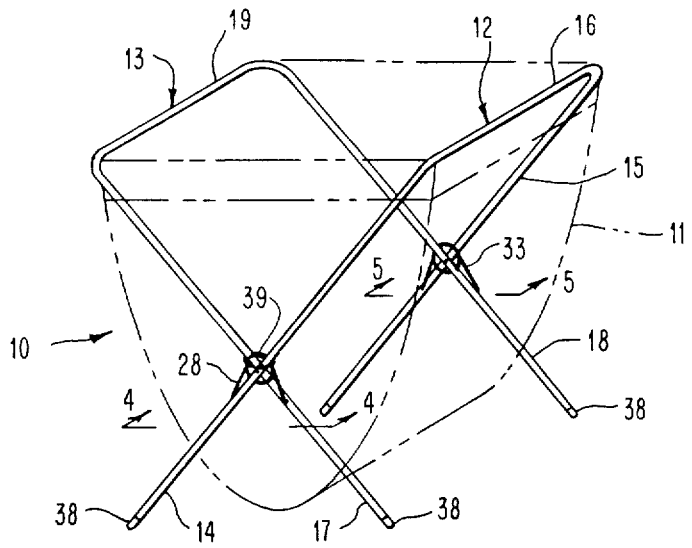
FIG. 1 is a perspective view of an adjustable bag holder of the present invention in its maximum open position for the largest size bag that the bag holder can support with a bag mounted thereon and shown in phantom.

Referring to the drawings and particularly FIG. 1, there is shown an adjustable bag holder 10 for supporting a bag 11, which can vary in capacity from twenty-six gallons to seven bushels, thereon. The adjustable bag holder 10 includes a first U-shaped tubular element 12 and a second U-shaped tubular element 13 cooperating with each other with the sizes of the first U-shaped tubular element 12 and the second U-shaped tubular element 13 determining the capacities of the bag 11 that the bag holder 10 can support.

The first U-shaped element 12 includes a first leg 14, a second leg 15 substantially parallel to the first leg 14, and a connector 16 extending between one end of each of the first leg 14 and the second leg 15 and being substantially perpendicular to each. The second U-shaped tubular element 13 includes a first leg 17, a second leg 18 substantially parallel to the first leg 17, and a connector 19 extending between one end of each of the first leg 17 and the second leg 18 and being substantially perpendicular to each.

The first U-shaped element 12 is slightly larger than the second U-shaped element 13. Thus, the first leg 14 of the first U-shaped tubular element 12 is outside of the first leg 17 of the second U-shaped tubular element 13, and the second leg 15 of the first U-shaped tubular element 12 is outside of the second leg 18 of the second U-shaped tubular element 13.

The first leg 14 of the first U-shaped tubular element 12 and the first leg 17 of the second U-shaped tubular element 13 are pivotally connected to each other intermediate their ends by a tubular rivet 20 (see FIG. 6) extending through a passage 21 in the first leg 14 of the first U-shaped tubular element 12 and a passage 22 in the first leg 17 of the second U-shaped tubular element 13. The tubular rivet 20 attaches the first leg 14 of the first U-shaped tubular element 12 to the first leg 17 of the second U-shaped tubular element 13.

The second leg 15 (see FIG. 5) of the first U-shaped tubular element 12 is pivotally connected to the second leg 18 of the second U-shaped tubular element 13 by a tubular rivet 24 extending through aligned passages (not shown) in the second leg 15 of the first U-shaped tubular element 12 and in the second leg 18 of the second U-shaped tubular element 13 in the same manner as the tubular rivet 20 (see FIG. 6) extends through the passage 21 in the first leg 14 of the first U-shaped element 12 and the passage 22 in the first leg 17 of the second U-shaped element 13. The tubular rivet 24 (see FIG. 5) attaches the second leg 15 of the first U-shaped tubular element 12 to the second leg 18 of the second U-shaped tubular element 13.

The tubular rivets 20 (see FIG. 6) and 24 (see FIG. 5) are axially aligned with each other. Therefore, pivoting occurs about a common axis for the two tubular rivets 20 (see FIG. 6) and 24 (see FIG. 5), which are preferably disposed slightly closer to the support or bottom ends of the legs 14 (see FIG. 1), 15, 17, and 18 than to the connectors 16 and 19 although such is not a requisite for satisfactory operation. Thus, if desired, the pivotal axis could be closer to the connectors 16 and 19 than to the support or bottom ends of the legs 14, 15, 17, and 18 or the same distance from each.

Any other suitable pivotal connecting means could be employed. For example, if desired, the tubular rivets 20 (see FIG. 6) and 24 (see FIG. 5) could be replaced by screws and lock nuts.

A torsion spring 28 (see FIG. 6) surrounds the portion of the tubular rivet 20 between the first leg 14 of the first U-shaped tubular element 12 and the first leg 17 of the second U-shaped tubular element 13. The torsion spring 28 has a first bent end 29 disposed within a hole 30 in the first leg 14 of the first U-shaped tubular element 12 to connect the first bent end 29 of the torsion spring 28 to the first leg 14 of the first U-shaped tubular element 12. The torsion spring 28 has its second bent end 31 disposed in a hole 32 in the first leg 17 of the second U-shaped tubular element 13 to connect the second bent end 31 of the torsion spring 28 to the first leg 17 of the second U-shaped tubular element 13.

A torsion spring 33 (see FIG. 5) surrounds the portion of the tubular rivet 24 between the second leg 15 of the first U-shaped tubular element 12 and the second leg 18 of the second U-shaped tubular element 13. The torsion spring 33 has a first bent end 34 disposed in a hole 35 in the second leg 15 of the first U-shaped tubular element 12 to connect the first bent end 34 of the torsion spring 33 to the second leg 15 of the first U-shaped tubular element 12. The torsion spring 33 has a second bent end 36 disposed in a hole 37 in the second leg 18 of the second U-shaped tubular element 13 to connect the second bent end 36 of the torsion spring 33 to the second leg 18 of the second U-shaped tubular element 13.

Accordingly, the torsion springs 28 (see FIG. 1) and 33 continuously urge the first U-shaped tubular element 12 and the second U-shaped tubular element 13 apart from each other about the axes of the tubular rivets 20 (see FIG. 6) and 24 (see FIG. 5) to such an extent that the first leg 14 (see FIG. 1) of the first U-shaped tubular element 12 is substantially perpendicular to the first leg 17 of the second U-shaped tubular element 13 and the second leg 15 of the first U-shaped tubular element 12 is substantially perpendicular to the second leg 18 of the second U-shaped tubular element 13. This is the maximum position to which the bag holder 10 can be automatically adjusted. This would be for the largest bag (seven bushels) that the bag holder 10 is designed to hold.

To position the bag 11 on the bag holder 10, the user must prevent the support or bottom ends of the first leg 14 of the first U-shaped tubular element 12 and the first leg 17 of the second U-shaped tubular element 13 from being moved away from each other by the forces of the torsion springs 28 and 33 by placing the user's feet exterior of the support or bottom ends in a position that results in the connector 16 of the first U-shaped tubular element 12 and the connector 19 of the second U-shaped tubular element 13 being disposed close enough to each other that the open end of the bag 11 can be folded over the connector 16 of the first U-shaped tubular element 12 and the connector 19 of the second U-shaped tubular element 13. After the open end of the bag 11 is so positioned over the connectors 16 and 19, the feet of the user are removed from holding the support or bottom ends of the first leg 14 of the first U-shaped tubular element 12 and the first leg 17 of the second U-shaped tubular element 13 from moving away from each other, and the torsion springs 28 and 33 cause pivoting of the first U-shaped tubular element 12 and the second U-shaped tubular element 13 relative to each other to exert a sufficient tension on the bag 11 to hold it on the connector 16 of the first U-shaped tubular element 12 and the connector 19 of the second U-shaped tubular element 13.

Instead of the user's feet being disposed exterior of the first leg 14 of the first U-shaped tubular element 12 and the first leg 17 of the second U-shaped tubular element 13, they could be disposed exterior of the second leg 15 of the first U-shaped tubular element 12 and the second leg 18 of the second U-shaped tubular element 13. It is only necessary that pivoting of the first U-shaped tubular element 12 and the second U-shaped tubular element 13 away from each other by the torsion springs 28 and 33 be prevented.

Figure 3:
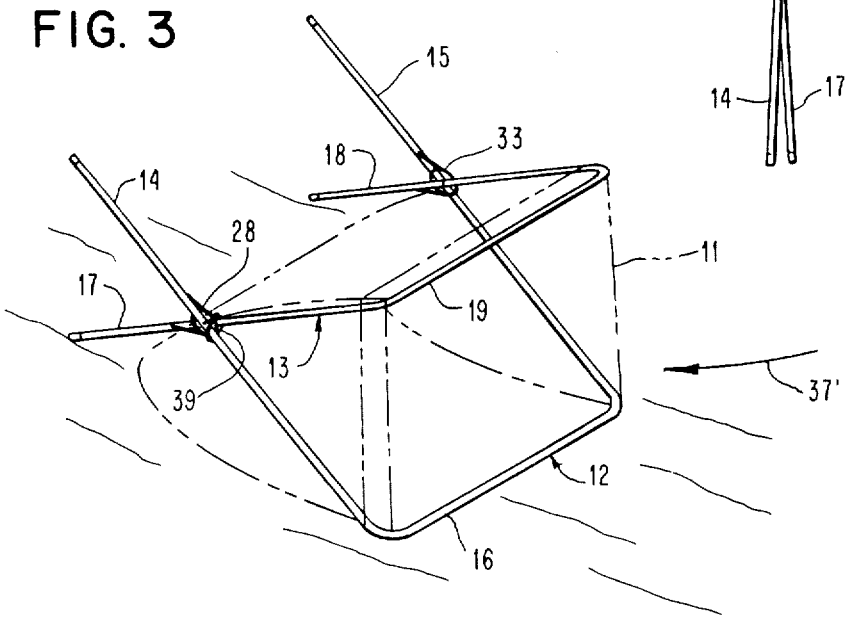
FIG. 3 is a perspective view of the bag holder of FIG. 1 disposed on its side to allow debris to be swept into it.

Thus, with the bag 11 supported by the bag holder 10, the bag 11 may be filled with debris through its open end. If desired, the bag holder 10 may be positioned on its side, as shown in FIG. 3, so that the bag 11 is open along the ground whereby leaves and other debris, for example, may be swept into the open end of the bag 11 as shown by arrow 37'.

Each of the first leg 14 (see FIG. 1) of the first U-shaped tubular element 12, the second leg 15 of the first U-shaped tubular element 12, the first leg 17 of the second U-shaped tubular element 13, and the second leg 18 of the second U-shaped tubular element 13 has a protective plastic cap 38 on its support or bottom end that engages the ground or driveway on which the bag holder 10 is to be positioned with the open end of the bag 11 facing upwardly. The caps 38 also prevent sliding of the bag holder 10 or marring of any indoor surface such as linoleum or hardwood, for example.

When it is desired to remove the bag 11 from the bag holder 10 such as when the bag 11 is full, the bag 11 is easily removed from the bag holder 10 through the user moving the connector 16 of the first U-shaped element 12 and the connector 19 of the second U-shaped element 13 towards each other against the forces of the the torsion springs 28 and 33. This is accomplished by the user either pushing the connectors 16 and 19 towards each other and grasping the open end of the bag 11 simultaneously or by pushing one of the support or bottom ends of the first leg 14 of the first U-shaped element 12 and the first leg 17 of the second U-shaped element 13 towards the other through the user holding one foot on the exterior of one of the first legs 14 and 17 and pushing on the other of the first legs 14 and 17 with the other foot or by pushing one of the support or bottom ends of the second leg 15 of the first U-shaped element 12 and the second leg 18 of the second U-shaped element 13 towards the other through the user holding one foot on the exterior of one of the second legs 15 and 18 and pushing on the other of the second legs 15 and 18 with the other foot. After the bag 11 has its open end no longer under tension, it is easily closed in the normal manner.

Figure 2:
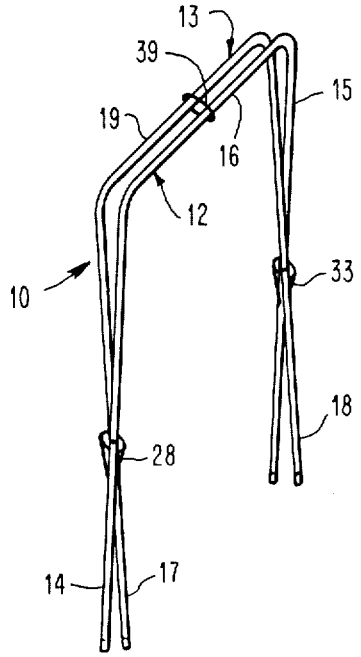
FIG. 2 is a perspective view of the bag holder of FIG. 1 in its collapsed condition for storage.

When the bag holder 10 is to be stored, the connector 16 of the first U-shaped tubular element 12 and the connector 19 of the second U-shaped tubular element 13 are moved towards each other against the forces of the torsion springs 28 and 33 to the position of FIG. 2. Then, a locking ring 39, which rests in an inactive position adjacent one of the tubular rivets 20 (see FIG. 6) and 24 (see FIG. 5), is moved up the first leg 14 (see FIG. 2) of the first U-shaped tubular element 12 and the first leg 17 of the second U-shaped tubular element 13, if it is resting adjacent the tubular rivet 20 (see FIG. 5), to overlie the connectors 16 (see FIG. 2) and 19 to hold them adjacent each other in a collapsed position against the forces of the torsion springs 28 and 33. The locking ring 39 is sized so that it does not affect the force of the torsion spring 28 or 33 when disposed adjacent the tubular rivet 20 (see FIG. 6) or 24 (see FIG. 5), respectively, in its inactive position.

Referring to FIG. 7, there is shown a modification in which the torsion springs 28 (see FIG. 1) and 33 are replaced by torsion springs (one shown at 40 in FIG. 7). The torsion spring 40 extends between the first leg 14 of the first U-shaped tubular element 12 and the first leg 17 of the second U-shaped tubular element 13 above the pivot axis of the bag holder 10. The torsion spring 40 has a bent end 41 (see FIG. 8) secured to the first leg 17 of the second U-shaped tubular element 13 by a cap nut 42 while the torsion spring 40 has its other end extend into an opening (not shown) in the first leg 14 (see FIG. 7) of the first U-shaped tubular element 12. There is a similar connection of a second torsion spring like the torsion spring 40 between the second leg 15 (see FIG. 1) of the first U-shaped tubular element 12 and the second leg 18 of the second U-shaped tubular element 13.

Instead of using the torsion spring (one shown at 40 in FIG. 7), tension springs (one shown in phantom at 43) may be substituted therefor to provide a tension. The tension springs (one shown at 43) could be elastomeric members if desired.

As previously mentioned, the bag holder 10 is capable of handling bags having a capacity between twenty-six gallons and seven bushels. Capacities between these two sizes that can be supported by the bag holder 10 are thirty gallons, thirty-three gallons, four bushels, five bushels, and six bushels. Accordingly, the bag 11 (see FIG. 1) can have a relatively large difference in capacity and still be utilized with the bag holder 10 of the present invention.

An advantage of this invention is that the bag is retained in position on a bag holder without any clips or other retaining means. Another advantage of this invention is that the bag holder requires only a small floor area for storage. A further advantage of this invention is that the bag holder may be used on any surface. Still another advantage of this invention is that the open end of the bag can be positioned with it either facing upwardly or to a side.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

I claim:

1. An adjustable bag holder for holding bags of various sizes including:

a first U-shaped element having:

a first leg;

a second leg substantially parallel to said first leg;

and a connector extending between said first leg and said second leg and substantially perpendicular thereto;

a second U-shaped element having:

a first leg;

a second leg substantially parallel to said first leg;

and a connector extending between said first leg and said second leg and substantially perpendicular thereto;

first pivot means for pivotally connecting said first leg of said first U-shaped element and said first leg of said second U-shaped element to each other intermediate their ends;

second pivot means for pivotally connecting said second leg of said first U-shaped element and said second leg of said second U-shaped element to each other intermediate their ends, said first pivot means and said second pivot means having their axes aligned;

first continuously urging means connected to said first leg of said first U-shaped element and said first leg of said second U-shaped element for continuously urging said first leg of said first U-shaped element and said first leg of said second U-shaped element apart irrespective of the relative positions of said first leg of said first U-shaped element and said first leg of said second U-shaped element;

second continuously urging means connected to said second leg of said first U-shaped element and said second leg of said second U-shaped element for continuously urging said second leg of said first U-shaped element and said second leg of said second U-shaped element apart irrespective of the relative positions of said second leg of said first U-shaped element and said second leg of said second U-shaped element;

and said first continuously urging means and said second continuously urging means cooperating to cause said connectors of said first U-shaped element and said second U-shaped element to be moved away from each other and exert a tension on a bag disposed over said connectors to retain the bag thereon.

2. The adjustable bag holder according to claim 1 in which:

said first continuously urging means is mounted in surrounding relation to said first pivot means and connected to said first leg of said first U-shaped element and said first leg of said second U-shaped element;

and said second continuously urging means is mounted in surrounding relation to said second pivot means and connected to said second leg of said first U-shaped element and said second leg of said second U-shaped element.

3. The adjustable bag holder according to claim 2 including retaining means mounted on said first U-shaped element and said second U-shaped element and movable between a position in which said retaining means retains said connector of said first U-shaped element and said connector of said second U-shaped element adjacent each other so that said adjustable bag holder is retained in a collapsed non-bag holding position and a position on said first leg of said first U-shaped element and said first leg of said second U-shaped element adjacent said first pivot means or on said second leg of said first U-shaped element and said second leg of said second U-shaped element adjacent said second pivot means to allow each of said first continuously urging means and said second continuously urging means to be effective.

4. The adjustable bag holder according to claim 3 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends.

5. The adjustable bag holder according to claim 2 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends.

6. The adjustable bag holder according to claim 1 in which:

said first continuously urging means comprises a torsion spring surrounding said first pivot means and having one of its ends connected to said first leg of said first U-shaped element and the other of its ends connected to said first leg of said second U-shaped element;

and said second continuously urging means comprises a torsion spring surrounding said second pivot means and having one of its ends connected to said second leg of said first U-shaped element and the other of its ends connected to said second leg of said second U-shaped element.

7. The adjustable bag holder according to claim 6 including retaining means mounted on said first U-shaped element and said second U-shaped element and movable between a position in which said retaining means retains said connector of said first U-shaped element and said connector of said second U-shaped element adjacent each other so that said adjustable bag holder is retained in a collapsed non-bag holding position and a position on said first leg of said first U-shaped element and said first leg of said second U-shaped element adjacent said first pivot means or on said second leg of said first U-shaped element and said second leg of said second U-shaped element adjacent said second pivot means to allow each of said first torsion spring and said second torsion spring to be effective.

8. The adjustable bag holder according to claim 7 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends.

9. The adjustable bag holder according to claim 7 in which no portion of said tension spring surrounding said first pivot means extends beyond the outer side of the outermost of said first leg of said first U-shaped element and said first leg of said second U-shaped element and no portion of said torsion spring surrounding said second pivot means extends beyond the outer side of the outermost of said second leg of said first U-shaped element and said second leg of said second U-shaped element when said adjustable bag holder is in its collapsed non-bag holding position.

10. The adjustable bag holder according to claim 6 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends.

11. The adjustable bag holder according to claim 1 including retaining means mounted on said first U-shaped element and said second U-shaped element and movable between a position in which said retaining means retains said connector of said first U-shaped element and said connector of said second U-shaped element adjacent each other so that said adjustable bag holder is retained in a collapsed non-bag holding position and a position on said first leg of said first U-shaped element and said first leg of said second U-shaped element adjacent said first pivot means or on said second leg of said first U-shaped element and said second leg of said second U-shaped element adjacent said second pivot means to allow each of said first continuously urging means and said second continuously urging means to be effective.

12. The adjustable bag holder according to claim 11 in which: said first pivot means pivotally connects said first leg of said first U-shaped element and said first leg of said second U-shaped element closer to their bottom ends; and said second pivot means pivotally connects said second leg of said first U-shaped element and said second leg of said second U-shaped element closer to their bottom ends.

13. The adjustable bag holder according to claim 1 in which: said first pivot means pivotally connects said first leg of said first U-shaped element and said first leg of said second U-shaped element closer to their bottom ends; and said second pivot means pivotally connects said second leg of said first U-shaped element and said second leg of said second U-shaped element closer to their bottom ends.

14. The adjustable bag holder according to claim 1 in which no portion of said first continuously urging means extends beyond the outer side of the outermost of said first leg of said first U-shaped element and said first leg of said second U-shaped element and no portion of said second continuously urging means extends beyond the outer side of the outermost of said second leg of said first U-shaped element and said second leg of said second U-shaped element when said adjustable bag holder is in its collapsed non-bag holding position.

* * * * *

UNITED STATES PATENT AND TRADEMARK OFFICE

CERTIFICATE OF CORRECTION

PATENT NO. : 4,723,741

DATED : February 9, 1988

INVENTOR(S) : Charles W. Doering

It is certified that error appears in the above-identified patent and that said Letters Patent is hereby corrected as shown below:

Column 10, lines 14 to 22 should read ---

12. The adjustable bag holder according to claim 11 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends. ---.

UNITED STATES PATENT AND TRADEMARK OFFICE

CERTIFICATE OF CORRECTION

PATENT NO. : 4,723,741

DATED : February 9, 1989

INVENTOR(S) : Charles W. Doering

It is certified that error appears in the above-identified patent and that said Letters Patent is hereby corrected as shown below:

Column 10, lines 23 to 30 should read ---

13. The adjustable bag holder according to claim 1 in which:

said first pivot means pivotally connects said first leg of said first U-shaped element and said first leg of said second U-shaped element closer to their bottom ends;

and said second pivot means pivotally connects said second leg of said first U-shaped element and said second leg of said second U-shaped element closer to their bottom ends. ---.

Signed and Sealed this
Fifth Day of July, 1988

*Attest:*

*Attesting Officer*

DONALD J. QUIGG

*Commissioner of Patents and Trademarks*